US010931086B2

(12) United States Patent
Shimamoto et al.

(10) Patent No.: US 10,931,086 B2
(45) Date of Patent: Feb. 23, 2021

(54) SPARK PLUG INCLUDING A GROUND ELECTRODE HAVING SLANTED SURFACES AND A FACING PORTION FACING A DISTAL END SURFACE OF A CENTER ELECTRODE

(71) Applicant: DENSO CORPORATION, Kariya (JP)

(72) Inventors: Daisuke Shimamoto, Kariya (JP); Yuya Abe, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/927,043

(22) Filed: Jul. 13, 2020

(65) Prior Publication Data

US 2020/0343697 A1 Oct. 29, 2020

Related U.S. Application Data

(63) Continuation of application No. PCT/JP2018/046534, filed on Dec. 18, 2018.

(30) Foreign Application Priority Data

Jan. 15, 2018 (JP) ..... JP2018-004184
Oct. 31, 2018 (JP) ..... JP2018-206053

(51) Int. Cl.

| | |
|---|---|
| ***H01T 13/32*** | (2006.01) |
| ***H01T 13/39*** | (2006.01) |
| ***H01T 13/02*** | (2006.01) |
| *F02P 13/00* | (2006.01) |

(52) U.S. Cl.
CPC ..... *H01T 13/32* (2013.01); *H01T 13/02* (2013.01); *H01T 13/39* (2013.01); *F02P 13/00* (2013.01)

(58) Field of Classification Search
CPC ..... H01T 13/32; H01T 13/39; H01T 21/02; H01T 13/02
See application file for complete search history.

(56) References Cited

U.S. PATENT DOCUMENTS

2013/0328476 A1 12/2013 Ban et al.
2020/0112145 A1* 4/2020 Akiyoshi ..... H01T 13/32

FOREIGN PATENT DOCUMENTS

JP 2016-184558 10/2016
JP 2017-147086 8/2017

* cited by examiner

*Primary Examiner* — Joseph L Williams
(74) *Attorney, Agent, or Firm* — Nixon & Vanderhye P.C.

(57) ABSTRACT

A spark plug includes a ground electrode facing a distal end surface of a center electrode. In a main body of the ground electrode, a first slanted surface is formed at a portion on a side facing the distal end surface and upstream of the center electrode relative to the airflow, a facing portion, a second slanted surface is formed at a portion on a side opposite to the side facing the distal end surface and upstream of the center electrode relative to the airflow, and when T represents a thickness of the main body of the ground electrode and Su represents a distance from a connection between the first slanted surface and the second slanted surface to the facing portion, $2T/16 \leq Su \leq 8T/16$.

12 Claims, 15 Drawing Sheets

SPARK PLUG INCLUDING A GROUND ELECTRODE HAVING SLANTED SURFACES AND A FACING PORTION FACING A DISTAL END SURFACE OF A CENTER ELECTRODE

CROSS-REFERENCE TO RELATED APPLICATION

The present application is a continuation application of International Application No. PCT/JP2018/046534 filed on Dec. 18, 2018, which is based on and claims the priority to Japanese Patent Application No. 2018-004184 filed on Jan. 15, 2018 and Japanese Patent Application No. 2018-206053 filed on Oct. 31, 2018. The contents of these applications are incorporated herein by reference in their entirety.

BACKGROUND

The present disclosure relates to a spark plug.

Conventional spark plugs include a center electrode and a ground electrode, in which a plane along the curved ground electrode is orthogonal to a flow direction of airflow.

SUMMARY

A first means for solving the above problem is a spark plug including:

a cylindrical main metal fitting;

a center electrode; and a ground electrode, in which in a main body of the ground electrode, a first slanted surface is formed at a portion on a side facing the distal end surface of the center electrode and upstream of the center electrode, the first slanted surface approaching the distal end surface toward a downstream side of the airflow, a facing portion that is least distant from the distal end surface is provided, a second slanted surface is formed at a portion on a side opposite to the side facing the distal end surface of the center electrode, and upstream of the center electrode, the second slanted surface receding from the distal end surface toward the downstream side of the airflow, and when T represents a thickness of the main body of the ground electrode and Su represents a distance from a connection between the first slanted surface and the second slanted surface to the facing portion, $2T/16 \leq Su \leq 8T/16$.

BRIEF DESCRIPTION OF THE DRAWINGS

The above-described and other objects, features, and advantages of the present disclosure will become more apparent from the following detailed description made with reference to the accompanying drawings. In the drawings.

DETAILED DESCRIPTION OF THE PREFERRED EMBODIMENTS

Figure 1:
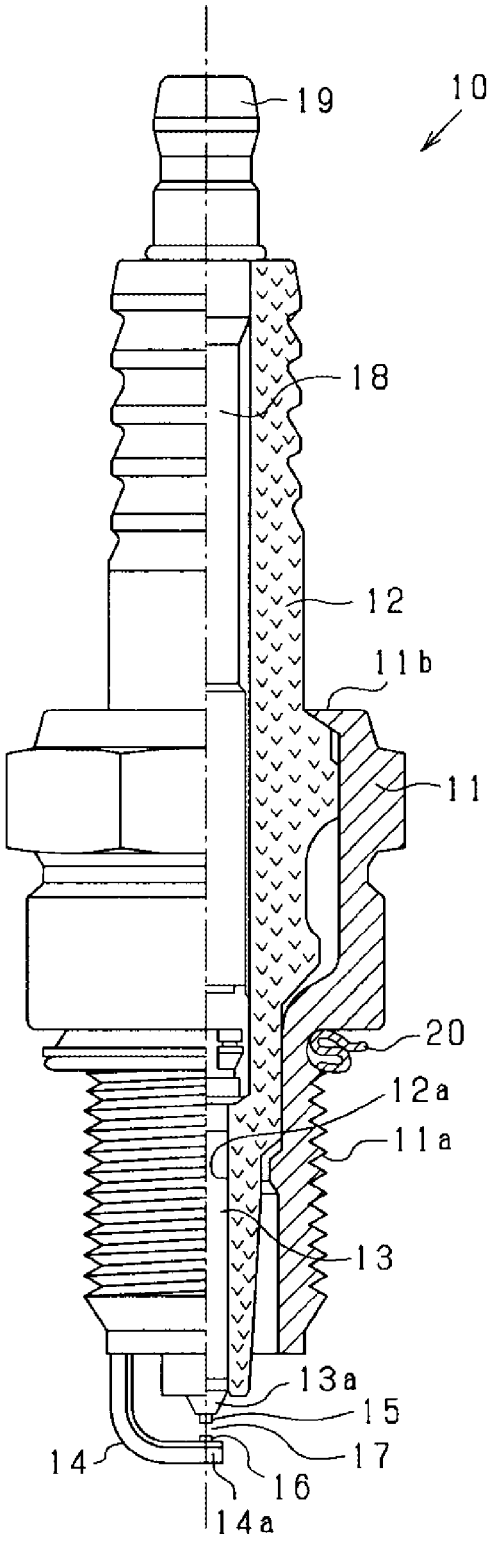
FIG. 1 is a half cross-sectional view of a spark plug.

Conventional spark plugs include a center electrode and a ground electrode, in which a plane along the curved ground electrode is orthogonal to a flow direction of airflow. In the conventional spark plug disclosed in JP 2017-147086 A, assuming that the airflow flows through between the center electrode and the ground electrode from left to right, an upper side and a lower side of the ground electrode are sloped down with a projection disposed on an upper side of the ground electrode upstream of a center shaft of the center electrode relative to the airflow. This causes a trailing vortex downstream of the ground electrode and a stretched discharge spark is sucked in the trailing vortex to be retained.

The spark plug described in JP 2017-147086 A is, however, likely to make the airflow having passed through between the center electrode and the ground electrode turbulent, frequently causing middle portions of the stretched discharge spark to be short-circuited with each other. Accordingly, there is a possibility that the discharge spark may become unstable, lowering ignition performance of the spark plug for an air-fuel mixture of fuel and air.

The present disclosure has been made to solve the above-described problem and a main object thereof is to provide a spark plug that allows for improving an ignition performance for an air-fuel mixture.

A first means for solving the above problem is a spark plug including:

a cylindrical main metal fitting;

a center electrode inserted in the main metal fitting; and a ground electrode coupled to the main metal fitting and curved so as to face a distal end surface of the center electrode with a predetermined plane along the curved ground electrode facing in a flow direction of airflow, in which in a main body of the ground electrode, a first slanted surface is formed at a portion on a side facing the distal end surface of the center electrode and upstream of the center electrode relative to a flow of the airflow, the first slanted surface approaching the distal end surface from an upstream side toward a downstream side of the airflow, a facing portion that is least distant from the distal end surface is provided at a position facing the distal end surface, a second slanted surface is formed at a portion on a side opposite to the side facing the distal end surface of the center electrode, and upstream of the center electrode, relative to the flow of the airflow, the second slanted surface receding from the distal end surface from the upstream side toward the downstream side of the airflow, and when with respect to an insertion direction of the center electrode, T represents a thickness of the main body of the ground electrode and Su represents a distance from a connection between the first slanted surface and the second slanted surface to the facing portion, $2T/16 \leq Su \leq 8T/16$.

In the above-described configuration, the ground electrode coupled to the main metal fitting is curved so as to face the distal end surface of the center electrode. The airflow flows toward the predetermined plane that is along the curved ground electrode, that is, from a side of the ground electrode toward the center electrode and the ground electrode. Discharge is then caused between the center electrode and the ground electrode and an air-fuel mixture of fuel and air is ignited with a discharge spark.

Here, in the main body of the ground electrode, the first slanted surface is formed at the portion on the side facing the distal end surface of the center electrode and upstream of the center electrode relative to the flow of the airflow, the first slanted surface approaching the distal end surface from the upstream side toward the downstream side of the airflow. Further, the main body of the ground electrode includes the facing portion, which is least distant from the distal end surface, at the position facing the distal end surface. The airflow flowing into the region between the center electrode and the ground electrode is thus controlled by the first slanted surface, allowing for stably stretching the discharge spark. It should be noted that in a case where the ground electrode includes a noble metal chip, a portion of the ground electrode other than the noble metal chip corresponds to the main body of the ground electrode. Meanwhile, in a case where the ground electrode includes no noble metal chip, the ground electrode is identical to the main body of the ground electrode.

In the main body of the ground electrode, the second slanted surface is formed at the portion on the side opposite to the side facing the distal end surface of the center electrode and upstream of the center electrode relative to the flow of the airflow, the second slanted surface receding from the distal end surface from the upstream side toward the downstream side of the airflow. The airflow is thus led in a direction away from the ground electrode by the second slanted surface, causing negative pressure downstream of the ground electrode. This negative pressure makes it possible to lead the airflow having passed between the center electrode and the ground electrode and, consequently, the discharge spark in the direction away from the center electrode. The discharge spark can thus be stretched in the direction away from the center electrode, allowing for improving the ignition performance for the air-fuel mixture.

Further, the disclosers of the present application have found that the ignition performance for the air-fuel mixture is improved if in the main body of the ground electrode, with respect to the insertion direction of the center electrode, $2T/16 \leq Su \leq 8T/16$, where T represents the thickness of the main body of the ground electrode and Su represents the distance from the connection between the first slanted surface and the second slanted surface to the above-described facing portion. Therefore, the above-described spark plug allows for improving the ignition performance for the air-fuel mixture.

In a second means, in the main body of the ground electrode, a third slanted surface is formed at a portion on the side facing the distal end surface of the center electrode and downstream of the center electrode relative to the flow of the airflow, the third slanted surface receding from the distal end surface from the upstream side toward the downstream side of the airflow, and a fourth slanted surface is formed at a portion on the side opposite to the side facing the distal end surface of the center electrode and downstream of the center electrode relative to the flow of the airflow, the fourth slanted surface approaching the distal end surface from the upstream side toward the downstream side of the airflow, and when Sd represents a distance from a connection between the third slanted surface and the fourth slanted surface to the facing portion with respect to the insertion direction of the center electrode, $2T/16 \leq Sd \leq 8T/16$.

In the above-described configuration, in the main body of the ground electrode, the third slanted surface is formed at the portion on the side facing the distal end surface of the center electrode and downstream of the center electrode relative to the flow of the airflow, the third slanted surface receding from the distal end surface from the upstream side toward the downstream side of the airflow. The third slanted surface can thus accelerate leading of the airflow having passed through between the center electrode and the ground electrode in the direction away from the center electrode by the above-described negative pressure. Further, an origin of the discharge spark in the ground electrode can be displaced from the upstream side toward the downstream side of the airflow along the third slanted surface, thereby allowing for increasing a distance between the origin of the discharge spark in the ground electrode and the center electrode. Therefore, the middle portions of the discharge spark can be restrained from being short-circuited with each other.

In the main body of the ground electrode, the fourth slanted surface is formed at the portion on the side opposite to the side facing the distal end surface of the center electrode and downstream of the center electrode relative to the flow of the airflow, the fourth slanted surface approaching the distal end surface from the upstream side toward the downstream side of the airflow. The fourth slanted surface can thus accelerate the separation of the airflow led by the second slanted surface from the ground electrode. Therefore, the negative pressure formed downstream of the ground electrode can be enhanced, allowing for more forcefully leading the airflow having passed through between the center electrode and the ground electrode and, consequently, the discharge spark in the direction away from the center electrode.

Further, the disclosers of the present application have found that the ignition performance for the air-fuel mixture is improved if in the main body of the ground electrode, with respect to the insertion direction of the center electrode, $2T/16 \leq Sd \leq 8T/16$, where Sd represents the distance from the connection between the third slanted surface and the fourth slanted surface to the facing portion. Therefore, the above-described spark plug 10 allows for a further improved ignition performance for the air-fuel mixture.

In a case where the spark plug is attached to a combustion chamber, the flow direction of the airflow relative to the spark plug is sometimes temporarily reversed during a combustion process of the air-fuel mixture in the combustion chamber.

In this regard, in a third means, in the main body of the ground electrode, with respect to the insertion direction of the center electrode, the distance from the connection between the first slanted surface and the second slanted surface to the facing portion and the distance from the connection between the third slanted surface and the fourth slanted surface to the facing portion are equal. For this reason, even when the flow direction of the airflow relative to the spark plug is temporarily reversed during the combustion process, the respective functions of the first slanted surface and the third slanted surface can be switched hand the respective functions of the second slanted surface and the fourth slanted surface can be switched. Therefore, even when the flow direction of the airflow relative to the spark plug is temporarily reversed during the combustion process, the ignition performance for the air-fuel mixture can be improved. Further, even when the ground electrode is attached with an upstream side and a downstream side thereof inverted with respect to the combustion chamber, the ignition performance for the air-fuel mixture can be improved as in a case where it would be attached in a correct orientation.

In a fourth means, in the main body of the ground electrode, $4T/16 \leq Su \leq 6T/16$ and $4T/16 \leq Sd \leq 6T/16$ with respect to the insertion direction of the center electrode.

The disclosers of the present application have found that the ignition performance for the air-fuel mixture is further improved if in the main body of the ground electrode, with respect to the insertion direction of the center electrode, $4T/16 \leq Su \leq 6T/16$ and $4T/16 \leq Sd \leq 6T/16$. Therefore, the above-described spark plug allows for a further improved ignition performance for the air-fuel mixture.

In a fifth means, in the main body of the ground electrode, when W represents a width of the main body of the ground electrode with respect to a direction orthogonal to the predetermined plane, $2 \leq W/T \leq 2.36$.

The disclosers of the present application have found that the ignition performance for the air-fuel mixture is further improved if in the main body of the ground electrode, with respect to the direction orthogonal to the predetermined plane, $2 \leq W/T \leq 2.36$, where W represents the width of the main body of the ground electrode. Therefore, the above-described spark plug allows for a further improved ignition performance for the air-fuel mixture.

In a sixth means, an outer surface of the connection between the first slanted surface and the second slanted surface and an outer surface of the connection between the third slanted surface and the fourth slanted surface are each in a form of a rounded surface. This makes it easier, in displacing the origin of the discharge spark in the ground electrode from the upstream side toward the downstream side of the airflow along the third slanted surface (the first slanted surface in reverse), to displace the origin of the discharge spark in the ground electrode to a position farther away from the center electrode along the outer surface of the connection. Therefore, since the discharge spark is easily displaced to the position farther away from the center electrode, the ignition performance for the air-fuel mixture can be further improved.

In a seventh means, the second slanted surface and the fourth slanted surface are recessed toward a center of the main body of the ground electrode. The second slanted surface (the fourth slanted surface in reverse) can thus enhance the airflow flowing in the direction away from the ground electrode. Further, the fourth slanted surface (the second slanted surface in reverse) can accelerate the separation of the airflow from the ground electrode. These make it possible to enhance the negative pressure formed downstream of the ground electrode. Therefore, the airflow having passed through between the center electrode and the ground electrode and, consequently, the discharge spark can be led in the direction farther away from the center electrode, allowing for further improving the ignition performance for the air-fuel mixture.

In an eighth means, a portion of the facing portion facing the distal end surface of the center electrode is provided with a first noble metal chip. This makes it easier to cause discharge between the ground electrode and the center electrode by virtue of the concentration of electric field that occurs at the first noble metal chip while restraining the consumption of the ground electrode due to the discharge.

In a ninth means, the third slanted surface is provided with a second noble metal chip. This makes it easier to displace the origin of the discharge spark in the ground electrode to the second noble metal chip by virtue of the concentration of electric field that occurs at the second noble metal chip. Further, the consumption of the ground electrode due to the discharge can be restrained by the second noble metal chip.

In a tenth means, a third noble metal chip extending from a portion of the facing portion facing the distal end surface of the center electrode to a predetermined position in the third slanted surface is provided. This makes it easier to cause discharge between the ground electrode and the center electrode by virtue of the concentration of electric field that occurs at the third noble metal chip. Further, the origin of the discharge spark in the ground electrode can be easily displaced toward the downstream side of the airflow along the third noble metal chip. In addition, the consumption of the ground electrode due to the discharge can be restrained by the third noble metal chip.

In an eleventh means, a height of a projection of the first noble metal chip from the facing portion is in a range from 0.2 mm to 1.0 mm. The disclosers of the present application have found that the ignition performance for the air-fuel mixture is improved in a case where the height of the projection of the first noble metal chip from the facing portion of the ground electrode is 0.2 mm or more. The disclosers of the present application have also found that the first noble metal ship is severely consumed in a case where the height of the projection of the first noble metal chip from the facing portion of the ground electrode exceeds 1.0 mm. Accordingly, the above-described spark plug allows for improving the ignition performance for the air-fuel mixture while restraining the consumption of the first noble metal chip.

In a twelfth means, a distal end portion of the center electrode is provided with a fourth noble metal chip. This makes it easier to cause discharge between the center electrode and the ground electrode by virtue of the concentration of electric field that occurs at the fourth noble metal chip while restraining the consumption of the center electrode due to the discharge.

An embodiment in which the present disclosure is implemented in a spark plug used for an internal combustion engine will be described below with reference to the drawings.

As illustrated in FIG. 1, a spark plug 10 includes a cylindrical housing 11 including a metal material such as iron. A periphery of a lower portion of the housing 11 (main metal fitting) is provided with a screw thread 11*a*.

A lower end portion of a cylindrical insulator 12 is coaxially inserted in the housing 11. The insulator 12 is formed from an insulating material such as alumina. An upper end portion 11*b* of the housing 11 is clamped onto the insulator 12, thereby integrally coupling the housing 11 and the insulator 12. Further, a lower portion (one end portion) of the insulator 12 has a through hole 12*a* (hollow portion) in which a center electrode 13 is inserted to be held.

The center electrode 13 includes an Ni alloy, which is excellent in heat resistance, etc., as a base material thereof and is in a columnar shape. Specifically, an inner material (center material) of the center electrode 13 includes copper and an outer material (exterior material) thereof includes an Ni (nickel) base alloy. A distal end portion 13*a* of the center electrode 13 is exposed from a lower end (one end) of the insulator 12.

A ground electrode 14, which is curved to extend integrally from a lower end surface (one end surface) of the housing 11, is disposed at a position facing the distal end portion 13*a* of the center electrode 13. That is, the ground electrode 14 is coupled to the housing 11 while being curved with a distal end portion 14*a* thereof facing a distal end surface 15*a* (see FIG. 2) of the center electrode 13. The ground electrode 14 also includes a Ni base alloy.

Figure 2:
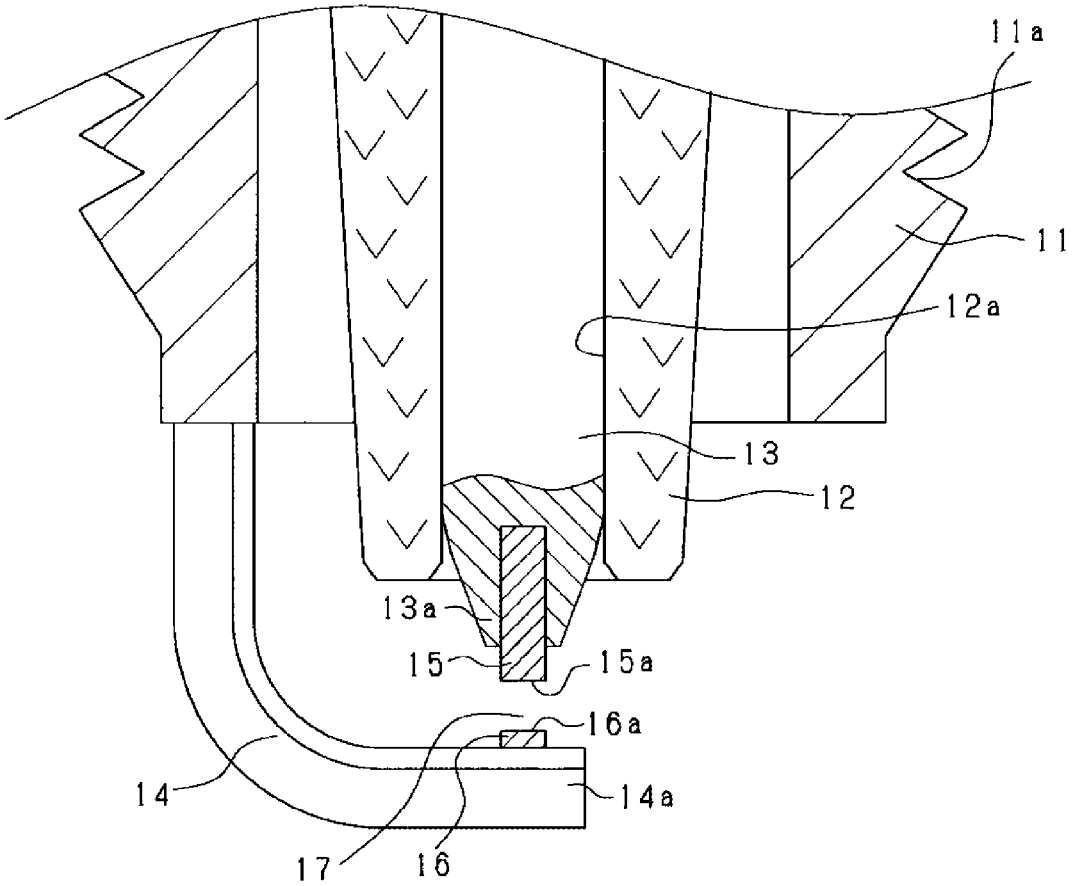
FIG. 2 is a partial enlarged view of FIG. 1.

As illustrated in FIG. 2, the center electrode 13 and the ground electrode 14 respectively include noble metal chips 15 and 16. The noble metal chips 15 and 16 are both in a columnar shape. The noble metal chips 15 and 16 each include Ir (iridium), which is excellent in exhaustion resistance at a high melting point, as a base and, additionally, an IrRh alloy including Rh (rhodium) for reducing a high-temperature volatility of Ir. The noble metal chips 15 and 16 are respectively bonded to the distal end portions 13*a* and 14*a* by a bonding process such as laser welding or resistance welding. A spark gap 17 is formed between the noble metal chip 15 (fourth noble metal chip) and the noble metal chip 16 (first noble metal chip). That is, discharge is caused between the noble metal chip 15 and the noble metal chip 16 to form a discharge spark. It should be noted that a portion of the ground electrode 14 other than the noble metal chip 16 corresponds to a main body of the ground electrode.

Referring back to FIG. 1, a center shaft 18 and a terminal unit 19 are electrically coupled to an upper portion of the center electrode 13 as conventionally known. An external circuit that applies a high voltage for generating a spark is coupled to the terminal unit 19. Further, an upper end portion of the screw thread 11*a* of the housing 11 is provided with a gasket 20 for use in attachment to an internal combustion engine. When the spark plug 10 is attached to a combustion chamber of the internal combustion engine, the center electrode 13 and the ground electrode 14 of the spark plug 10 are exposed in the combustion chamber.

Figure 3:
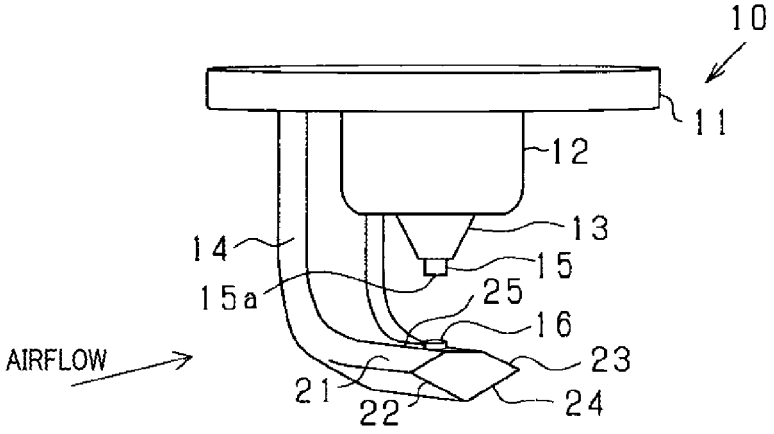
FIG. 3 is a perspective view of a distal end portion of a center electrode and a ground electrode.
Figure 4:
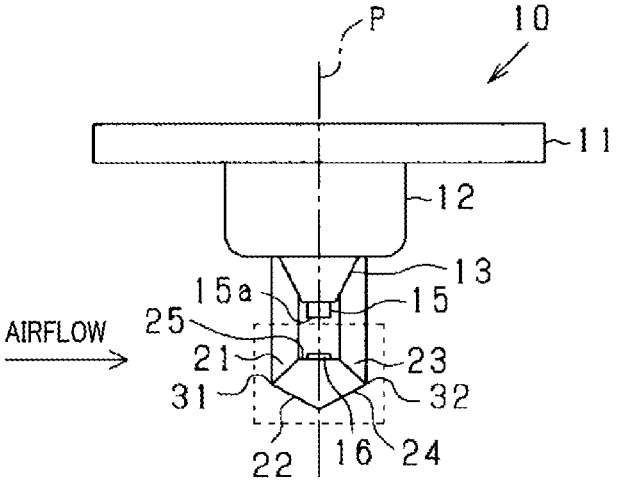
FIG. 4 is a front view of the distal end portion of the center electrode and the ground electrode.

FIG. 3 is a perspective view of the distal end portion of the center electrode 13 and the ground electrode 14. FIG. 4 is a front view of the distal end portion of the center electrode 13 and the ground electrode 14.

When the spark plug 10 is attached to the combustion chamber of the internal combustion engine, a predetermined plane P (see FIG. 4) along the curved ground electrode 14 faces a flow direction of airflow. In particular, the predetermined plane P is orthogonal to a flow direction of a majority of airflow toward the spark plug 10.

The main body of the ground electrode 14 has a first slanted surface 21 formed at a portion on a side (upper side) facing the distal end surface 15*a* of the center electrode 13 and upstream of the center electrode 13 relative to a flow of the airflow, the first slanted surface 21 approaching the distal end surface 15*a* from an upstream side toward a downstream side of the airflow. The first slanted surface 21 is formed so as to deflect airflow hitting the first slanted surface 21 toward the center electrode 13. The first slanted surface 21 becomes a flat surface near a position facing the center electrode 13. A surface extending from the first slanted surface 21 in a direction toward a connection between the ground electrode 14 and the housing 11 becomes a flat surface after being a curved surface.

The ground electrode 14 is symmetrically formed with respect to the predetermined plane P. Thus, the main body of the ground electrode 14 has a third slanted surface 23 formed at a portion on the side (upper side) facing the distal end surface 15*a* of the center electrode 13 and downstream of the center electrode 13 relative to the flow of the airflow, the third slanted surface 23 receding from the distal end surface 15*a* from the upstream side toward the downstream side of the airflow.

The main body of the ground electrode 14 has a second slanted surface 22 formed at a portion on a side (lower side) opposite to the side facing the distal end surface 15*a* of the center electrode 13 and upstream of the center electrode 13 relative to the flow of the airflow, the second slanted surface 22 receding from the distal end surface 15*a* from the upstream side to the downstream side of the airflow. The second slanted surface 22 is formed to deflect airflow hitting the second slanted surface 22 away from the center electrode 13. The second slanted surface 22 becomes a flat surface near a position facing the center electrode 13. A surface extending from the second slanted surface 22 in the direction toward the connection between the ground electrode 14 and the housing 11 becomes a flat surface after being a curved surface.

The ground electrode 14 is symmetrically formed with respect to the predetermined plane P. Thus, the main body of the ground electrode 14 has a fourth slanted surface 24 formed at a portion on the side (lower side) opposite to the side facing the distal end surface 15*a* of the center electrode 13 and downstream of the center electrode 13 relative to the flow of the airflow, the fourth slanted surface 24 approaching the distal end surface 15*a* from the upstream side toward the downstream side of the airflow.

Further, in the main body of the ground electrode 14, a facing portion 25 (chip mounting surface) of the main body of the ground electrode 14 is formed on the side facing the distal end surface 15*a* of the center electrode 13. The facing portion 25 is formed between the first slanted surface 21 and the third slanted surface 23. The facing portion 25 becomes a flat surface near a position facing the center electrode 13. A surface extending from the facing portion 25 in the direction toward the connection between the ground electrode 14 and the housing 11 becomes a flat surface after being a curved surface. The noble metal chip 16 is welded to the facing portion 25.

The main body of the ground electrode 14 includes the facing portion 25, which is least distant from the distal end surface 15*a*, at a position facing the distal end surface 15*a* of the center electrode 13. That is, a distance between the distal end surface 15*a* of the center electrode 13 and the main body of the ground electrode 14 is shortest at the facing portion 25. A distance between the ground electrode 14 and the distal end surface 15*a* of the center electrode 13 is shortest at a distal end surface 16*a* of the noble metal chip 16.

It should be noted that a portion of the ground electrode 14 other than the noble metal chip 16 (the main body of the ground electrode 14) is formed by bending a member having a uniform shape in a length direction thereof. A productivity of the ground electrode 14 can thus be enhanced.

Figure 5:
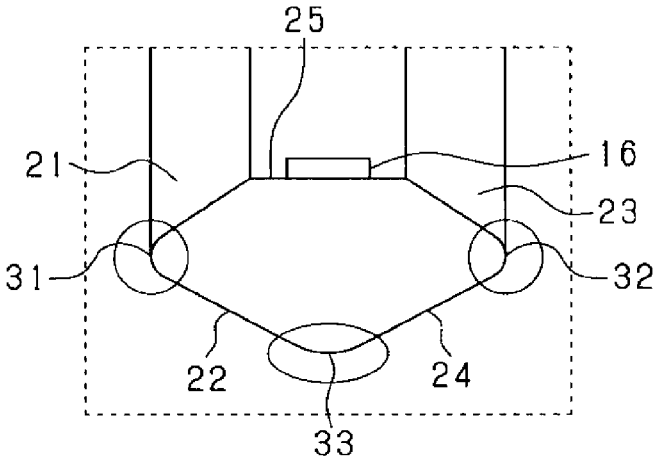
FIG. 5 is a partial enlarged view of FIG. 4.

FIG. 5 is a partial enlarged view of FIG. 4. As illustrated in circled portions, an outer surface of a connection 31 between the first slanted surface 21 and the second slanted surface 22 and an outer surface of a connection 32 between the third slanted surface 23 and the fourth slanted surface 24 are each in a form of a rounded surface. That is, the connections 31 and 32 are each in a form of a linearly extending R portion (semicylindrical portion). Further, an outer surface of a connection 33 between the first slanted surface 21 and the fourth slanted surface 24 is in a form of a rounded surface. That is, the connection 33 is in a form of a linearly extending R portion (semicylindrical portion).

Figure 6:
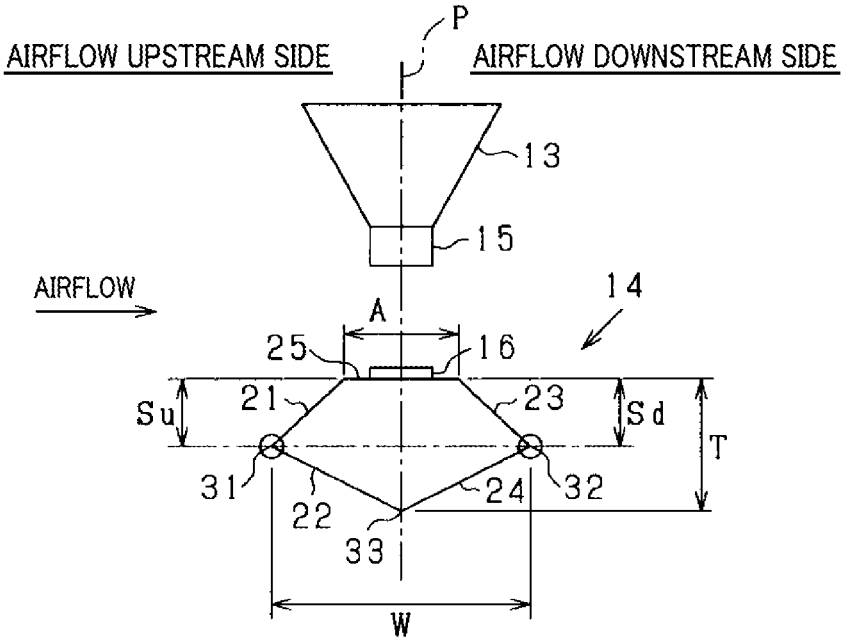
FIG. 6 is a schematic diagram illustrating dimensions of the ground electrode.

FIG. 6 is a schematic diagram illustrating dimensions of the ground electrode 14. This figure illustrates a cross section along a plane passing through a center axis of the center electrode 13 and parallel with the flow direction of the airflow.

With respect to a center axis direction of the center electrode 13 (a direction of insertion into the housing 11 and the insulator 12), a thickness of the main body of the ground electrode 14 is referred to as a thickness T and a distance from the connection 31 between the first slanted surface 21 and the second slanted surface 22 to the facing portion 25 is referred to as a distance Su. In this case, the distance Su is set so as to satisfy $2T/16 \leq Su \leq 8T/16$. Preferably, the distance Su is set so as to satisfy $4T/16 \leq Su \leq 6T/16$.

Likewise, with respect to the center axis direction of the center electrode 13, a distance from the connection 32 between the third slanted surface 23 and the fourth slanted surface 24 to the facing portion 25 is referred to as a distance Sd. In this case, the distance Sd is set so as to satisfy $2T/16 \leq Sd \leq 8T/16$. Preferably, the distance Sd is set so as to satisfy $4T/16 \leq Sd \leq 6T/16$. Further, the distance Su and the distance Sd are set equal (Su=Sd).

In the main body of the ground electrode 14, with respect to a direction orthogonal to the predetermined plane P (the flow direction of the airflow), a width of the main body of the ground electrode 14 is referred to as a width W and a width of the facing portion 25 is referred to as a width A. In this case, the thickness T and the width W are set so as to satisfy $2 \leq W/T \leq 2.36$.

Figure 7:
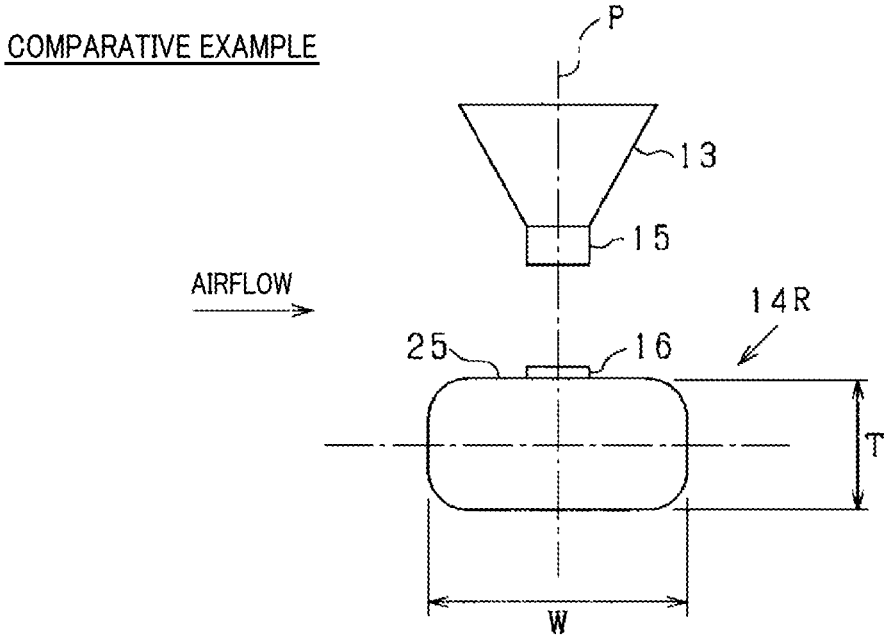
FIG. 7 is a schematic diagram illustrating dimensions of a ground electrode of a comparative example.

FIG. 7 is a schematic diagram illustrating dimensions of a ground electrode 14R of a comparative example. This figure illustrates a cross section along the plane passing through the center axis of the center electrode 13 and parallel with the flow direction of the airflow.

With respect to the center axis direction of the center electrode 13 (the direction of insertion into the housing 11 and the insulator 12), a thickness of the main body of the ground electrode 14R is referred to as the thickness T. Further, in the main body of the ground electrode 14R, with respect to the direction orthogonal to the predetermined plane P (the flow direction of the airflow), a width of the main body of the ground electrode 14R is referred to as a width W. The thickness T=1.3 [mm] and the width W=2.6 [mm] are set. The ground electrode 14R of the comparative example has none of the first slanted surface 21, the second slanted surface 22, the third slanted surface 23, and the fourth slanted surface 24. That is, a shape of the cross section of the main body of the ground electrode 14R is a rectangle.

Figure 8:
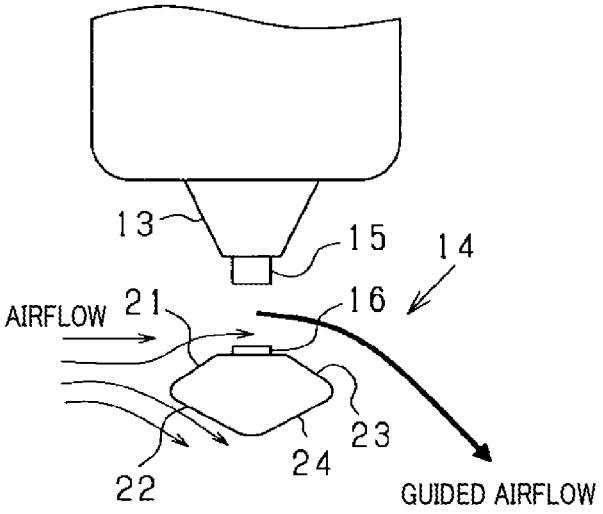
FIG. 8 is a schematic diagram illustrating a flow direction of airflow.

FIG. 8 is a schematic diagram illustrating the flow direction of the airflow relative to the ground electrode 14.

Among the airflow flowing toward the ground electrode 14, the airflow hitting the first slanted surface 21 is led along the first slanted surface 21 into between the noble metal chip 15 (center electrode 13) and the noble metal chip 16 (ground electrode 14). The airflow flowing through between the noble metal chip 15 and the noble metal chip 16 is thus controlled.

The airflow hitting the second slanted surface 22 is led along the second slanted surface 22 in a direction away from the ground electrode 14. The airflow is then separated from the ground electrode 14, causing a negative pressure downstream of the fourth slanted surface 24 (ground electrode 14). Further, since the main body of the ground electrode 14 has the fourth slanted surface 24, the airflow is easily separated from the ground electrode 14, enhancing the negative pressure formed downstream of the fourth slanted surface 24.

The airflow having passed through between the noble metal chip 15 and the noble metal chip 16 is led in a direction away from the center electrode 13 by the negative pressure formed downstream of the fourth slanted surface 24. Since the main body of the ground electrode 14 has the third slanted surface 23, the airflow is led along the third slanted surface 23 in the direction away from the center electrode 13.

Figure 9:
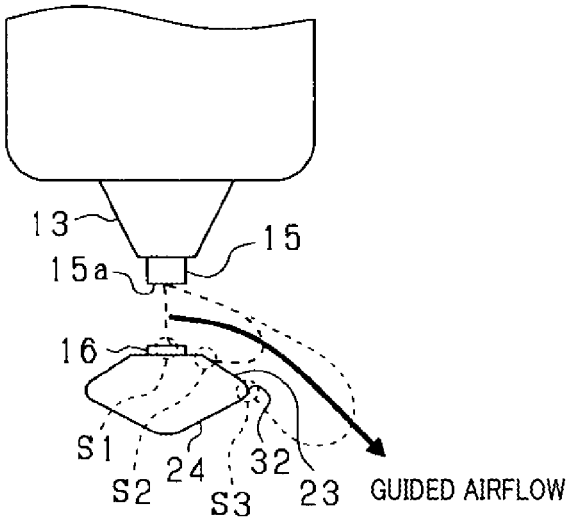
FIG. 9 is a schematic diagram illustrating a stretched manner of a discharge spark.

FIG. 9 is a schematic diagram illustrating a stretch manner of the discharge spark.

Initially, the discharge spark is generated between the distal end surface 15*a* of the center electrode 13 and an origin S1 in the distal end surface 16*a* of the noble metal chip 16 of the ground electrode 14. The discharge spark is then stably stretched by the controlled airflow between the noble metal chip 15 and the noble metal chip 16.

At this time, the origin of the discharge spark in the ground electrode 14 is displaced from the origin S1 to an origin S2 in the third slanted surface 23. A distance between the origin of the discharge spark in the ground electrode 14 and the noble metal chip 15 (center electrode 13) can thus be increased, allowing for restraining middle portions of the stretched discharge spark from being short-circuited with each other.

As described with reference to FIG. 8, the airflow having passed through between the noble metal chip 15 and the noble metal chip 16 is led in the direction away from the center electrode 13 by the negative pressure formed downstream of the fourth slanted surface 24. The discharge spark is led in the direction away from the center electrode 13 by the airflow while being stretched. At this time, the origin of the discharge spark in the ground electrode 14 is displaced from the origin S2 to an origin S3 in the third slanted surface 23. Further, the origin of the discharge spark in the ground electrode 14 is displaced from the origin S3 to a position distant from the center electrode 13 along the rounded outer surface of the connection 32.

The discharge spark is thus stably stretched in the direction away from the center electrode 13, allowing for improving an ignition performance for an air-fuel mixture. Here, a surface area of the discharge spark increases with an increase in a length of the discharge spark, increasing a contact area between the air-fuel mixture of the air-fuel mixture and air and the discharge spark and, consequently, improving the ignition performance for the air-fuel mixture. Further, combustibility of the air-fuel mixture is improved with the discharge spark stretched more in the direction away from the center electrode 13, that is, in a direction toward a center of the combustion chamber.

Figure 10:
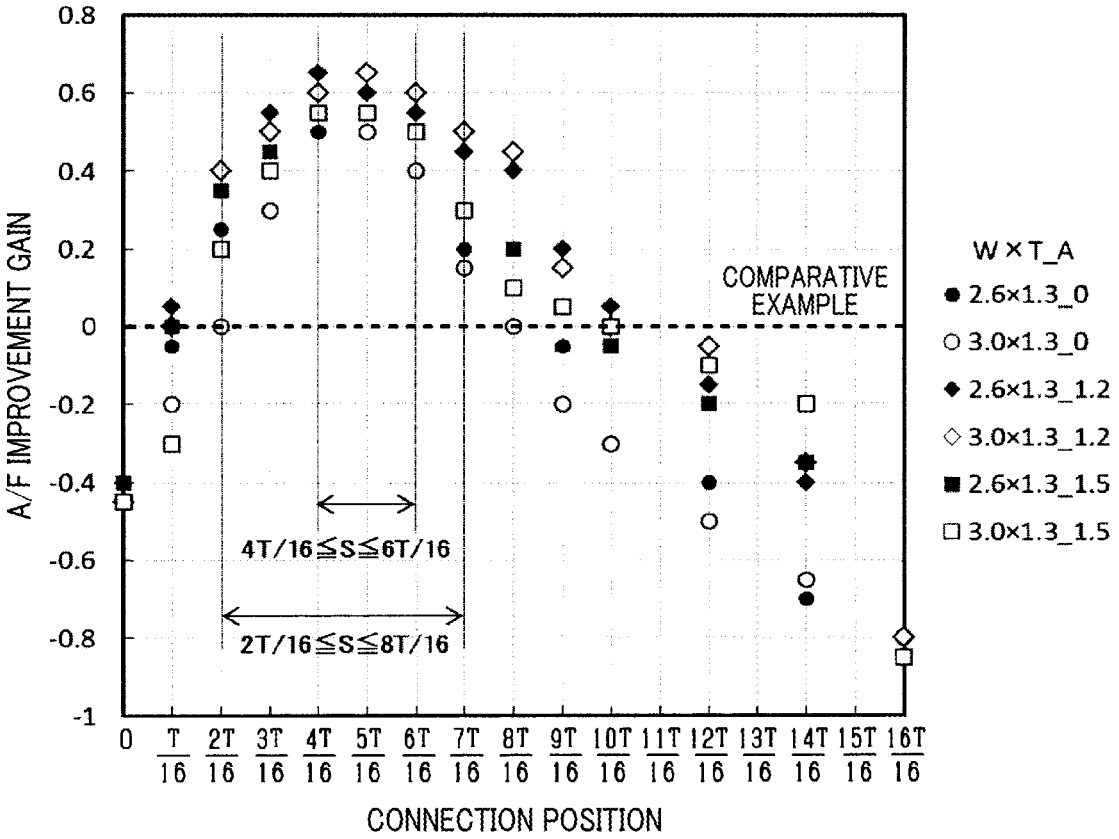
FIG. 10 is a graph showing a relationship between a connection position and an A/F improvement gain.

FIG. 10 is a graph showing a relationship between a connection position and an A/F improvement gain. The connection position is expressed as 0 in a case where the connection 31 (connection 32) is located at the facing portion 25 and expressed as 16T/16 in a case where it located at the connection 33. Taking a lean limit A/F of the combustion of the air-fuel mixture with the ground electrode 14R of the comparative example as a reference (0), the A/F improvement gain indicates how much the lean limit A/F of the ground electrode 14 is improved. The width W, the thickness T, and the width A are defined as described with reference to FIG. 6. A test was performed, where the width W was varied to 2.6 [mm] and 3.0 [mm], the thickness T to 1.3 [mm], and the width A to 0 [mm], 1.2 [mm], and 1.5 [mm], while a chip diameter of the noble metal chip 16 was fixed at ϕ 0.7 [mm] (in a case of A=1.2 [mm]) or ϕ 1.0 [mm] (A=1.5 [mm]) and a chip height of the noble metal chip 16 at 0.15 [mm]. It should be noted that the disclosers have found that the chip diameter and height had no influence on the flow of the airflow. Incidentally, it is supposed that the above-mentioned influence was not given because a volume of the noble metal chip 16 of the ground electrode 14 was small as compared with that of the main body of the ground electrode 14.

As illustrated in this figure, the A/F improvement gain of any sample is 0 or more in a range of $2T/16 \leq S \leq 8T/16$. In particular, in a range of $4T/16 \leq S \leq 6T/16$, the A/F improvement gain of any sample is 0.4 or more. Accordingly, the ignition performance for the air-fuel mixture can be improved by setting a distance S (distances Su and Sd) so as to satisfy $2T/16 \leq S \leq 8T/16$, particularly, $4T/16 \leq S \leq 6T/16$.

Figure 11:
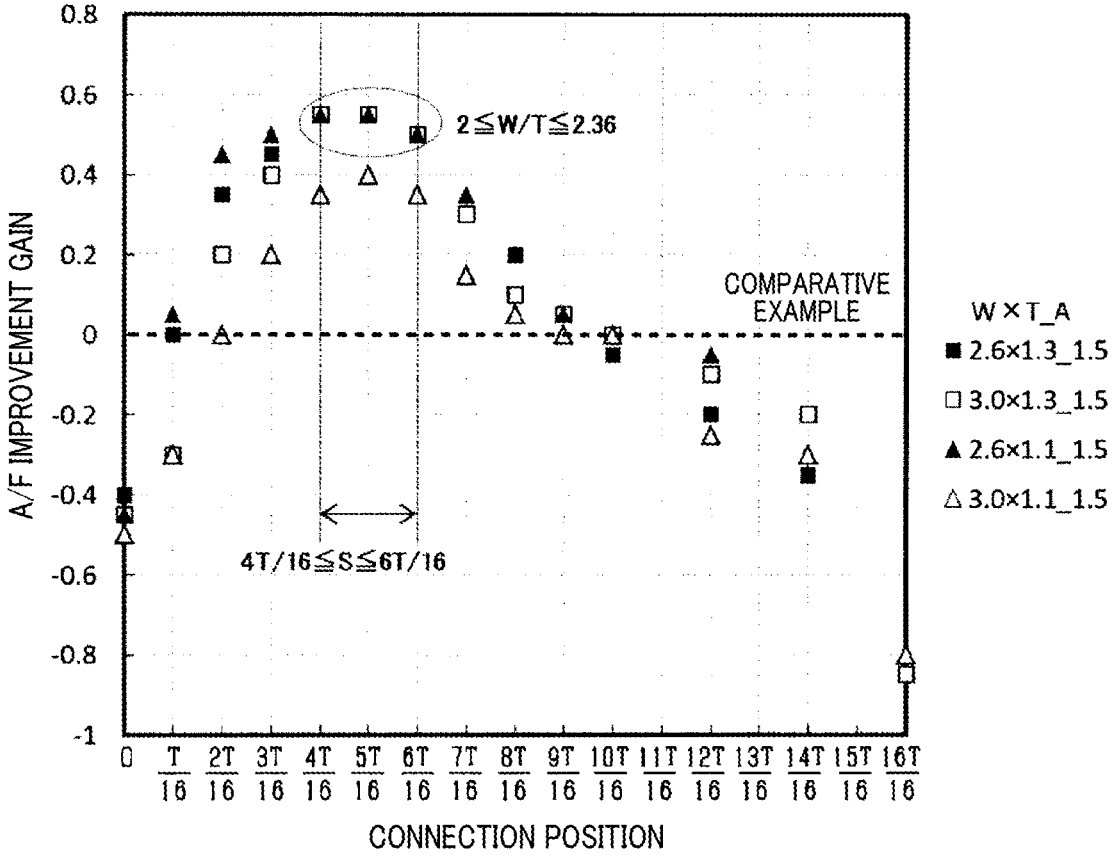
FIG. 11 is a graph showing a relationship between the connection position, a width/thickness ratio, and the A/F improvement gain.

FIG. 11 is a graph showing a relationship between the connection position, a width/thickness ratio W/T, and the A/F improvement gain. The connection position, the A/F improvement gain, the width W, the thickness T, and the width A are defined as in FIG. 10. The width W is varied to 2.6 [mm] and 3.0 [mm], the thickness T to 1.1 [mm] and 1.3 [mm], and the width A to 1.5 [mm].

As illustrated in this figure, in a range of $4T/16 \leq S \leq 6T/16$, the A/F improvement gain further increases when $2 \leq W/T \leq 2.36$. Accordingly, the ignition performance for the air-fuel mixture can be further improved by setting the distance S (distances Su and Sd), the width W, and the thickness T so as to satisfy $4T/16 \leq S \leq 6T/16$ and $2 \leq W/T \leq 2.36$.

Figure 12:
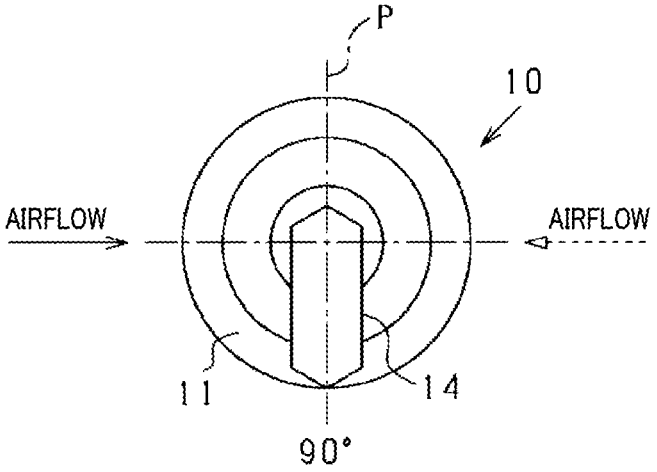
FIG. 12 is a schematic diagram illustrating a reverse manner of the airflow.

FIG. 12 is a schematic diagram illustrating a reverse manner of the airflow. The spark plug 10 is attached to the combustion chamber. The flow direction of the airflow relative to the spark plug 10 is sometimes temporarily reversed from a direction represented by a solid arrow to a direction represented by a dashed arrow during a combustion process of the air-fuel mixture in the combustion chamber.

In this regard, the ground electrode 14 is symmetrically formed with respect to the predetermined plane P with the above-described distance Su and the above-described distance Sd equalized. For this reason, even when the flow direction of the airflow relative to the spark plug 10 is temporarily reversed during the combustion process, the third slanted surface 23 achieves the function of the first slanted surface 21 and the fourth slanted surface 24 achieves the function of the second slanted surface 22. Further, the first slanted surface 21 achieves the function of the third slanted surface 23 and the second slanted surface 22 achieves the function of the fourth slanted surface 24. Therefore, even when the flow direction of the airflow relative to the spark plug 10 is temporarily reversed during the combustion process, the ignition performance for the air-fuel mixture can be improved.

Figure 13:
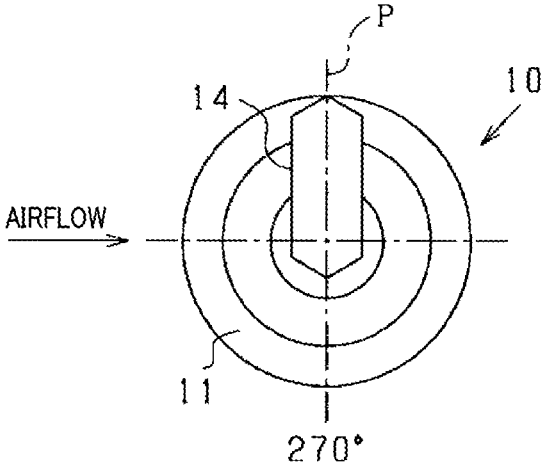
FIG. 13 is a schematic diagram illustrating an inversely attached state of the spark plug.

FIG. 13 is a schematic diagram illustrating an inversely attached state of the spark plug 10. In FIG. 13, an orientation of the ground electrode 14 is inverted with respect to an orientation of the ground electrode 14 of the spark plug 10 in FIG. 12. That is, an attachment angle of the spark plug 10 is shifted by 180° between FIG. 13 and FIG. 14. Even in an attachment state of the spark plug 10 in FIG. 13, the ignition performance for the air-fuel mixture can be improved as in a case where the flow direction of the airflow is reversed.

The present embodiment described above in detail has the following advantages.

- The main body of the ground electrode 14 has the first slanted surface 21 formed at the portion on the side facing the distal end surface 15*a* of the center electrode 13 and upstream of the center electrode 13 relative to the flow of the airflow, the first slanted surface 21 approaching the distal end surface 15*a* from the upstream side toward the downstream side of the airflow. Further, the main body of the ground electrode 14 includes the facing portion 25, which is least distant from the distal end surface 15*a*, at the position facing the distal end surface 15*a*. The airflow flowing into between the center electrode 13 and the ground electrode 14 is thus controlled by the first slanted surface 21, allowing for stably stretching the discharge spark.
- The main body of the ground electrode 14 has the second slanted surface 22 formed at the portion on the side opposite to the side facing the distal end surface 15*a* of the center electrode 13 and upstream of the center electrode 13 relative to the flow of the airflow, the second slanted surface 22 receding from the distal end surface 15*a* from the upstream side to the downstream side of the airflow. The airflow is led in the direction away from the ground electrode 14 by the second slanted surface 22, causing the negative pressure downstream of the ground electrode 14. This negative pressure makes it possible to lead the airflow having passed between the center electrode 13 and the ground electrode 14 and, consequently, the discharge spark in the direction away from the center electrode 13. The discharge spark can thus be stretched in the direction away from the center electrode 13, allowing for improving the ignition performance for the air-fuel mixture.
- The disclosers of the present application have found that the ignition performance for the air-fuel mixture is improved if in the main body of the ground electrode 14, with respect to the insertion direction of the center electrode, 13, $2T/16 \leq Su \leq 8T/16$, where the thickness T represents the thickness of the main body of the ground electrode 14 and the distance Su represents the distance from the connection 31 between the first slanted surface 21 and the second slanted surface 22 to the above-described facing portion 25. Therefore, the above-described spark plug 10 allows for improving the ignition performance for the air-fuel mixture.

The main body of the ground electrode 14 has the third slanted surface 23 formed at the portion on the side facing the distal end surface 15*a* of the center electrode 13 and downstream of the center electrode 13 relative to the flow of the airflow, the third slanted surface 23 receding from the distal end surface 15*a* from the upstream side toward the downstream side of the airflow. The third slanted surface 23 can thus accelerate leading of the airflow having passed through between the center electrode 13 and the ground electrode 14 in the direction away from the center electrode 13 by the above-described negative pressure. Further, the origin of the discharge spark in the ground electrode 14 is displaced from the upstream side toward the downstream side of the airflow along the third slanted surface 23, thereby allowing for increasing the distance between each of the origins S2 and S3 of the discharge spark in the ground electrode 14 and the center electrode 13. Therefore, the middle portions of the discharge spark can be restrained from being short-circuited with each other.

The main body of the ground electrode 14 has the fourth slanted surface 24 formed at the portion on the side opposite to the side facing the distal end surface 15*a* of the center electrode 13 and downstream of the center electrode 13 relative to the flow of the airflow, the fourth slanted surface 24 approaching the distal end surface 15*a* from the upstream side toward the downstream side of the airflow. The fourth slanted surface 24 can thus accelerate the separation of the airflow led by the second slanted surface 22 from the ground electrode 14. Therefore, the negative pressure formed downstream of the ground electrode 14 can be enhanced, allowing for more forcefully leading the airflow having passed through between the center electrode 13 and the ground electrode 14 and, consequently, the discharge spark in the direction away from the center electrode 13.

The disclosers of the present application have found that the ignition performance for the air-fuel mixture is improved if in the main body of the ground electrode 14, with respect to the insertion direction of the center electrode 13, $2T/16 \leq Sd \leq 8T/16$, where the distance Sd represents the distance from the connection 32 between the third slanted surface 23 and the fourth slanted surface 24 to the facing portion 25. Therefore, the above-described spark plug 10 allows for a further improved ignition performance for the air-fuel mixture.

In the main body of the ground electrode 14, with respect to the insertion direction of the center electrode 13, the distance Su from the connection 31 between the first slanted surface 21 and the second slanted surface 22 to the facing portion 25 and the distance Sd from the connection 32 between the third slanted surface 23 and the fourth slanted surface 24 to the facing portion 25 are equal. For this reason, even when the flow direction of the airflow relative to the spark plug 10 is temporarily reversed during the combustion process, the respective functions of the first slanted surface 21 and the third slanted surface 23 can be switched and the respective functions of the second slanted surface 22 and the fourth slanted surface 24 can be switched. Therefore, even when the flow direction of the airflow relative to the spark plug 10 is temporarily reversed during the combustion process, the ignition performance for the air-fuel mixture can be improved.

Even when the ground electrode 14 is attached to the combustion chamber with an upstream side and a downstream side thereof reversed, the ignition performance for the air-fuel mixture can be improved as in a case where it would be attached in a correct orientation.

The disclosers of the present application have found that the ignition performance for the air-fuel mixture is further improved if in the main body of the ground electrode 14, with respect to the insertion direction of the center electrode 13, $4T/16 \leq Su \leq 6T/16$ and $4T/16 \leq Sd \leq 6T/16$. Therefore, the above-described spark plug 10 allows for a further improved ignition performance for the air-fuel mixture.

The disclosers of the present application have found that the ignition performance for the air-fuel mixture is further improved if in the main body of the ground electrode 14, with respect to the direction orthogonal to the predetermined plane P, $2 \leq W/T \leq 2.36$, where the width W represents the width of the main body of the ground electrode 14. Therefore, the above-described spark plug 10 allows for a further improved ignition performance for the air-fuel mixture.

The outer surface of the connection 31 between the first slanted surface 21 and the second slanted surface 22 and the outer surface of the connection 32 between the third slanted surface 23 and the fourth slanted surface 24 are each in a form of a rounded surface. This makes it easier, in displacing the origin of the discharge spark in the ground electrode 14 from the upstream side toward the downstream side of the airflow along the third slanted surface 23 (the first slanted surface 21 in reverse), to displace the origin of the discharge spark in the ground electrode 14 to a position farther away from the center electrode 13 along the outer surface of the connection 32 (the connection 31 in reverse). Therefore, since the discharge spark is easily displaced to the position farther away from the center electrode 13, the ignition performance for the air-fuel mixture can be further improved.

It should be noted that the above-described embodiment may be implemented with the following modifications. Like reference signs are used to refer to the same elements as those of the above-described embodiment to omit the description thereof.

A configuration where none of the outer surfaces of the connections 31 to 33 is in a form of a rounded surface may be employed. In this case, machining of the ground electrode 14 is facilitated.

Figure 14A:
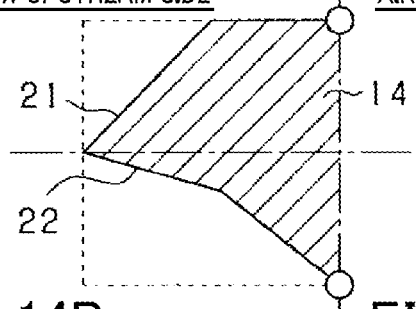
FIGS. 14A to 14H are schematic diagrams illustrating modification examples of a shape of the ground electrode on an airflow upstream side.
Figure 14B:
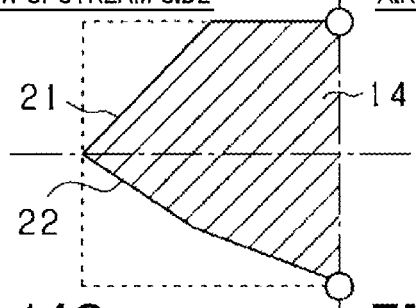
Figure 14C:
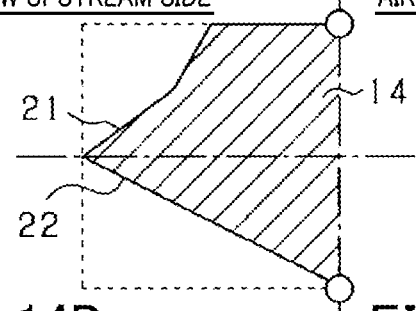
Figure 14D:
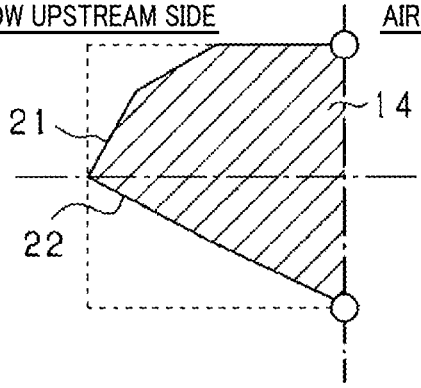
Figure 14E:
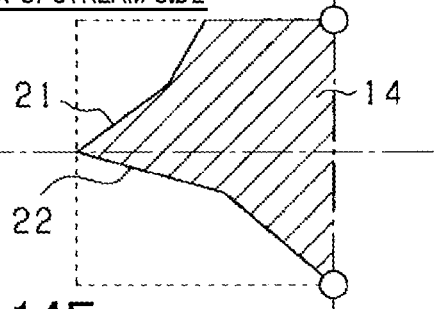
Figure 14F:
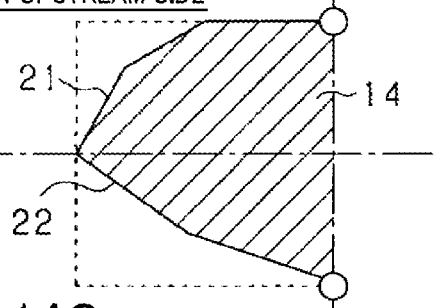
Figure 14G:
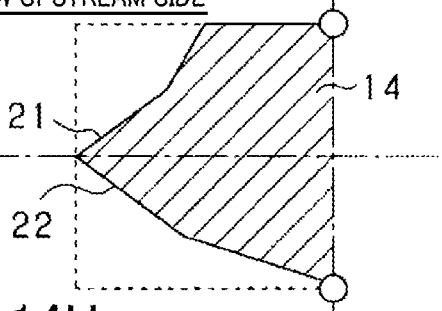
Figure 14H:
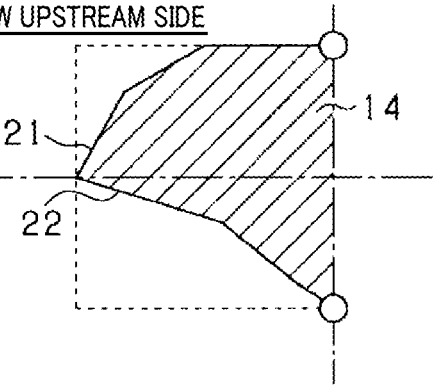

FIGS. 14A to 14H are schematic diagrams illustrating modification examples of a shape of the ground electrode 14 on an airflow upstream side. As illustrated in FIGS. 14C, E, and G, the first slanted surface 21 may be in a shape recessed toward a center of the main body of the ground electrode 14 and may include a plurality of flat surfaces. As illustrated in FIGS. 14 D, F, and H, the first slanted surface 21 may be in a shape protruding toward an outside of the main body of the ground electrode 14 and may include a plurality of flat surfaces. The same applies to the second slanted surface 22.

In particular, in FIGS. 14A, E, and H, the second slanted surface 22 is in a shape recessed toward the center of the main body of the ground electrode 14. The second slanted surface 22 can thus enhance the airflow flowing in the direction away from the ground electrode 14. This makes it possible to enhance the negative pressure formed downstream of the ground electrode 14. Therefore, the airflow having passed between the center electrode 13 and the ground electrode 14 and, consequently, the discharge spark can be led in the direction farther away from the center electrode 13, allowing for further improving the ignition performance for the air-fuel mixture. Further, in FIG. 14H, the first slanted surface 21 is in a shape protruding toward the outside of the main body of the ground electrode 14, thus allowing for further enhancing an effect of the first slanted surface 21 in rectifying the airflow.

Figure 15A:
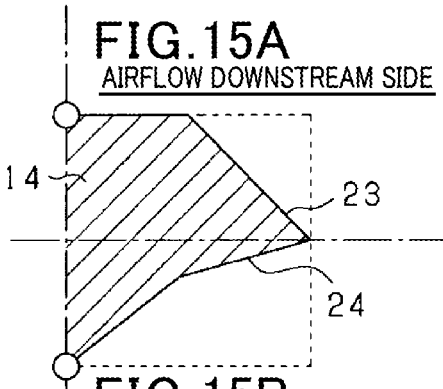
FIGS. 15A to 15H are schematic diagrams illustrating modification examples of a shape of the ground electrode on an airflow downstream side.
Figure 15B:
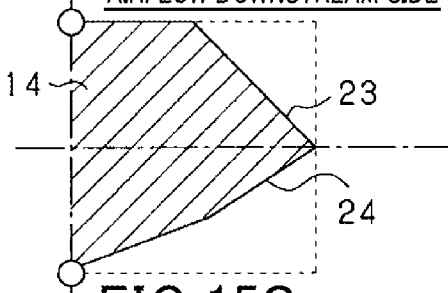
Figure 15C:
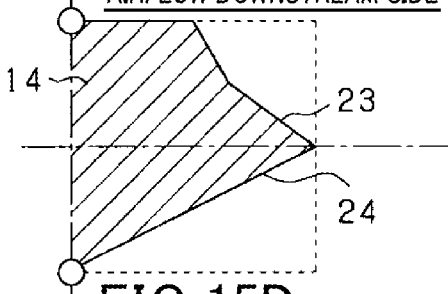
Figure 15D:
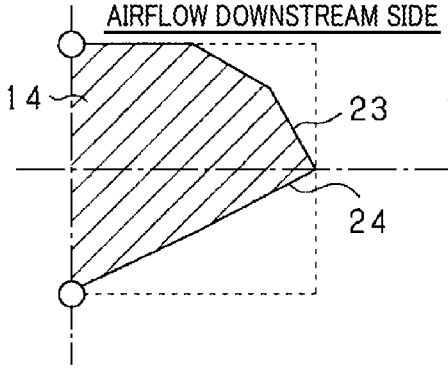
Figure 15E:
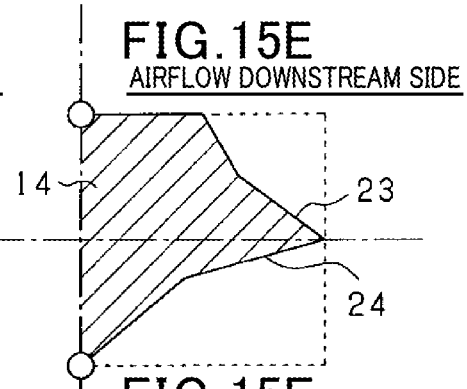
Figure 15F:
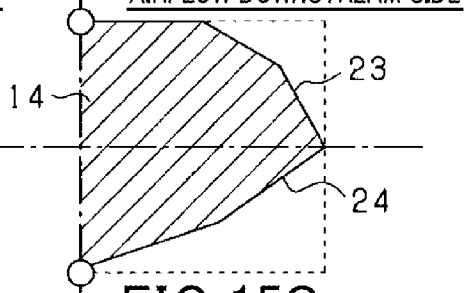
Figure 15G:
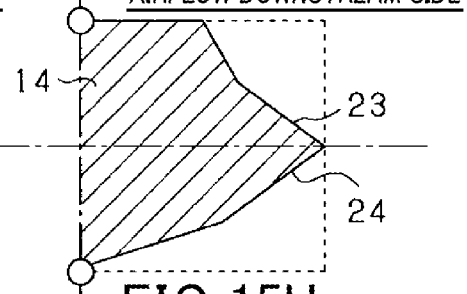
Figure 15H:
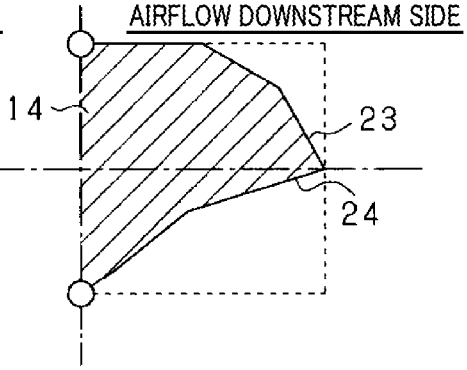

FIGS. 15A to 15H are schematic diagrams illustrating modification examples of a shape of the ground electrode 14 on an airflow downstream side. As illustrated in FIGS. 15C, E, and G, the third slanted surface 23 may be in a shape recessed toward the center of the main body of the ground electrode 14 and may include a plurality of flat surfaces. As illustrated in FIGS. 15D, F, and H, the third slanted surface 23 may be in a shape protruding toward the outside of the main body of the ground electrode 14 and may include a plurality of flat surfaces. The same applies to the fourth slanted surface 24.

In particular, in FIGS. 15A, E, and H, the fourth slanted surface 24 is in a shape recessed toward the center of the main body of the ground electrode 14. The fourth slanted surface 24 can thus accelerate the separation of the airflow from the ground electrode 14. This makes it possible to enhance the negative pressure formed downstream of the ground electrode 14. Therefore, the airflow having passed between the center electrode 13 and the ground electrode 14 and, consequently, the discharge spark can be led in the direction farther away from the center electrode 13, allowing for further improving the ignition performance for the air-fuel mixture. Further, in FIG. 15H, the third slanted surface 23 is in a shape protruding toward the outside of the main body of the ground electrode 14, so that the airflow can be led in the direction away from the center electrode 13 while being controlled by the third slanted surface 23.

It should be noted that the configurations of FIGS. 14A to 14H and FIGS. 15A to 15H may be combined as desired. Additionally, the first slanted surface 21, the second slanted surface 22, the third slanted surface 23, and the fourth slanted surface 24 may each be in a form of a curved surface.

Figure 16:
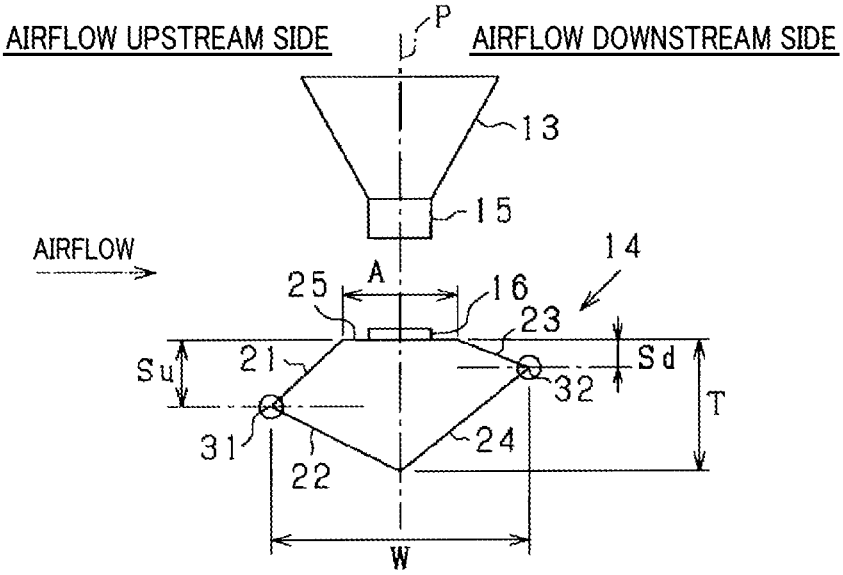
FIG. 16 is a schematic diagram illustrating a modification example of the ground electrode.

FIG. 16 is a schematic diagram illustrating a modification example of the ground electrode 14. This ground electrode 14 is not symmetrically formed with respect to the predetermined plane P and the distance Su and the distance Sd are not equal. Such a configuration can also achieve the effects according to the above-described embodiment by virtue of the first slanted surface 21, the second slanted surface 22, the third slanted surface 23, and the fourth slanted surface 24.

Figure 17:
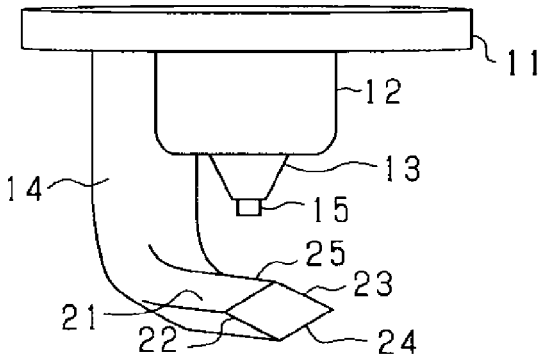
FIG. 17 is a perspective view illustrating another modification example of the ground electrode.
Figure 19:
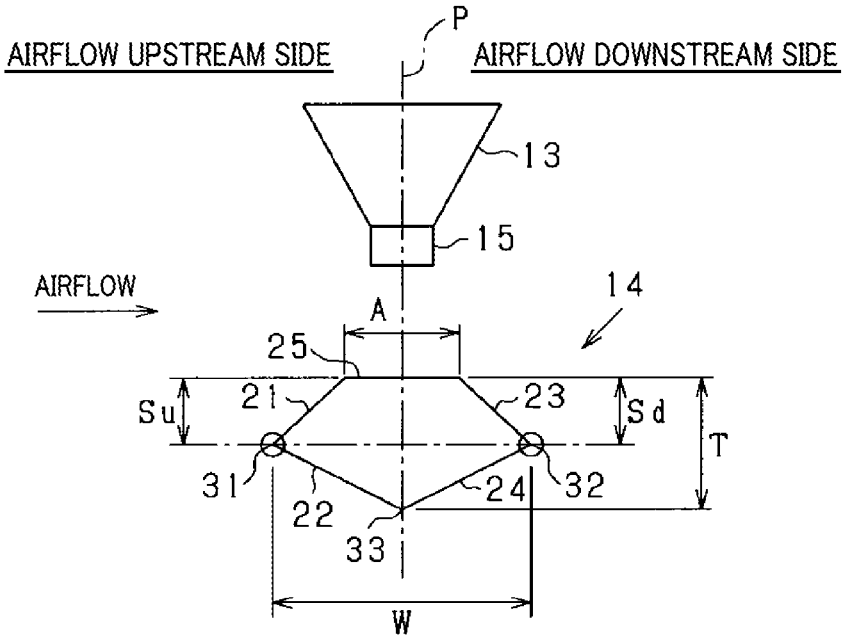
FIG. 19 is a schematic diagram illustrating another modification example of the ground electrode.

FIG. 17 is a perspective view illustrating another modification example of the ground electrode 14. The above-described facing portion 25 of the main body of this ground electrode 14 is not in a form of a flat surface but a ridge with the first slanted surface 21 and the third slanted surface 23 connected. Further, the ground electrode 14 does not include the noble metal chip 16. In addition, a vicinity of the distal end portion of the ground electrode 14 and any other portion thereof are different in shape in the length direction. Such a configuration can also achieve the effects according to the above-described embodiment by virtue of the first slanted surface 21, the second slanted surface 22, the third slanted surface 23, and the fourth slanted surface 24. It should be noted that in a case where the ground electrode 14 does not include the noble metal chip 16, the ground electrode 14 is identical to the main body of the ground electrode. Further, FIG. 19 is a schematic diagram illustrating a modification example of the ground electrode 14 not including the noble metal chip 16. In this case, the effects according to the above-described embodiment can also be achieved.

Figure 18:
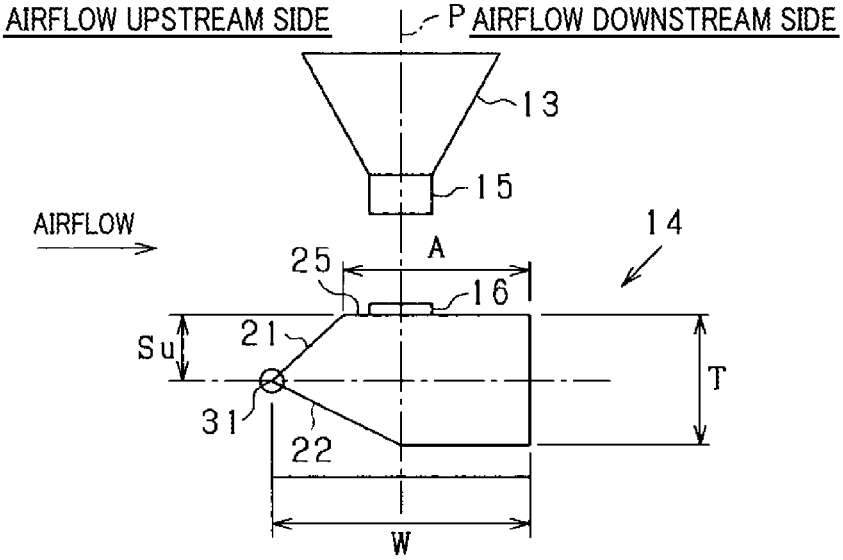
FIG. 18 is a schematic diagram illustrating another modification example of the ground electrode.

FIG. 18 is a schematic diagram illustrating another modification example of the ground electrode 14. The main body of this ground electrode 14 is provided with neither the above-described third slanted surface 23 nor fourth slanted surface 24. Such a configuration can also achieve the effects according to the above-described embodiment by virtue of the first slanted surface 21 and the second slanted surface 22.

Figure 20:
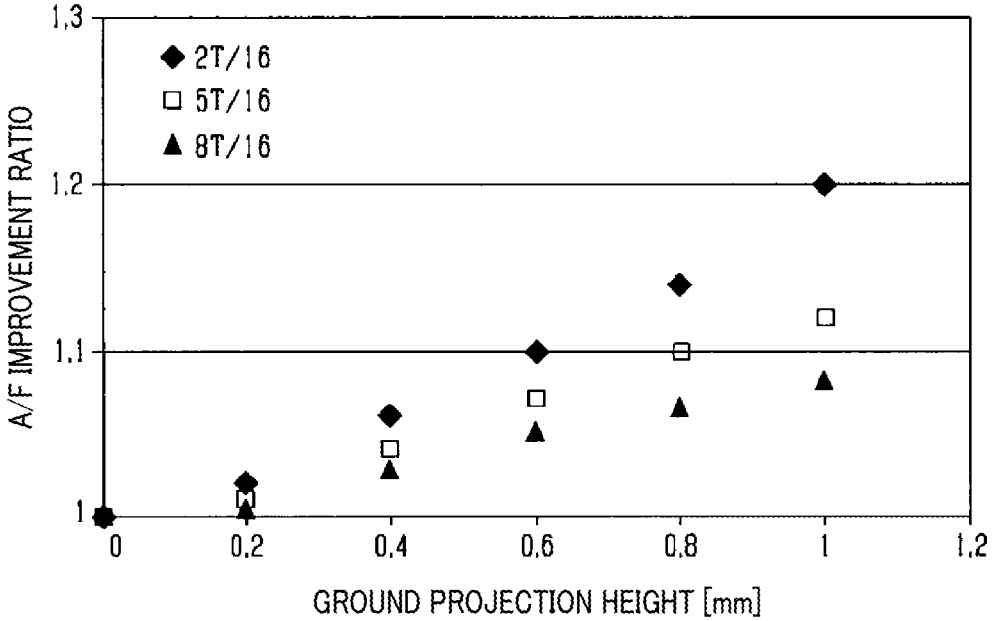
FIG. 20 is a graph showing a relationship between a height of projection of a noble metal chip of the ground electrode from a facing portion and an A/F improvement ratio.

FIG. 20 is a graph showing a relationship between a height of projection of the noble metal chip 16 from the facing portion 25 and an A/F improvement ratio. Taking a lean limit A/F of the combustion of the air-fuel mixture in a case of no noble metal chip 16 (projection height: 0 mm) as a reference (1), the A/F improvement ratio indicates, as a ratio, a lean limit A/F of each of the ground electrodes 14 including the noble metal chips 16 with various projection heights. The thickness T is defined as described with reference to FIG. 6. A test was performed, where the connection position was varied to 2T/16, 5T/16, and 8T/16. As illustrated in this figure, the lean limit A/F is improved at a projection height of 0.2 mm or more irrespective of the connection position. In particular, the lean limit A/F is improved with an increase in the projection height, allowing for improving the ignition performance for the air-fuel mixture. In a case where the spark gap 17 is constant irrespective of the projection height, the distance from the distal end surface 15*a* of the center electrode 13 to the facing portion 25 and the third slanted surface 23 increases with an increase in the projection height. Thus, with the origin of the discharge spark in the ground electrode 14 displaced to the third slanted surface 23, the discharge spark is stably stretched in the direction away from the center electrode 13, allowing for improving the ignition performance for the air-fuel mixture.

Figure 21:
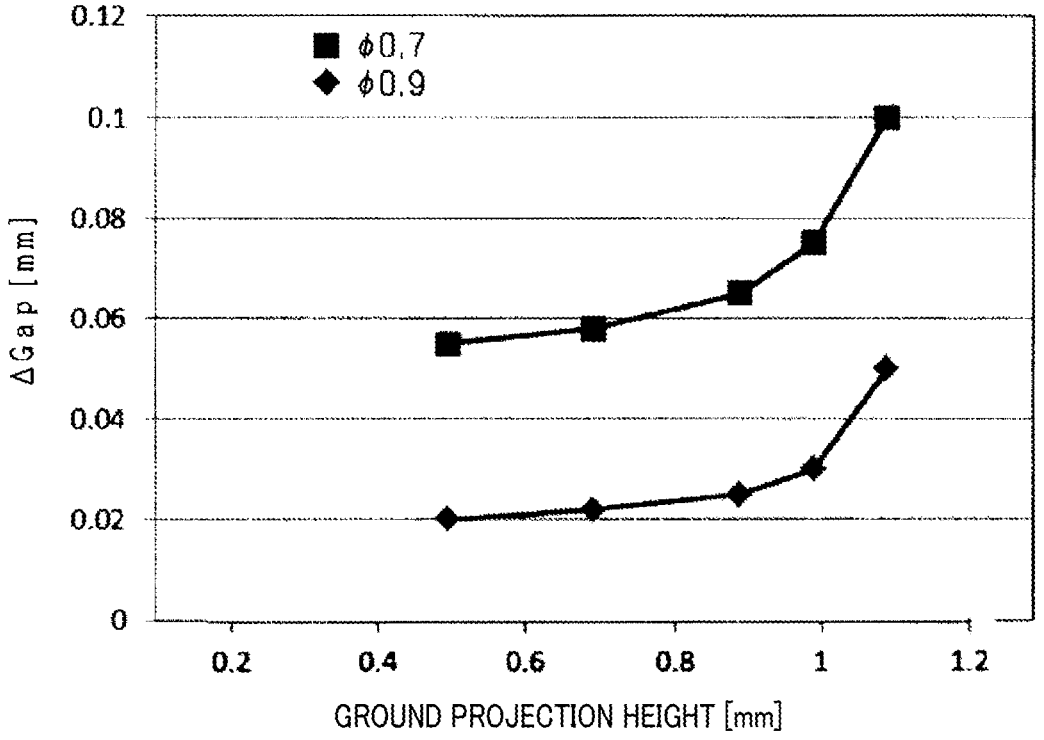
FIG. 21 is a graph showing a relationship between the height of the projection of the noble metal chip of the ground electrode from the facing portion and an extension amount of a spark gap.

However, at a projection height exceeding 1.0 mm, the noble metal chip 16 is severely consumed. FIG. 21 is a graph showing a relationship between the height of the projection of the noble metal chip 16 from the facing portion 25 and an extension amount \Gap of the spark gap 17. The extension amount \Gap of the spark gap 17 indicates an amount of extension of the spark gap 17 from the start to the end of discharge with the spark plug 10 performed for a predetermined period of time in a predetermined engine operating state. A test was performed, where the chip diameter of the noble metal chip 16 was varied to ϕ 0.7 [mm] and ϕ 0.9 [mm]. As illustrated in this figure, the extension amount \Gap rapidly increases at a projection height exceeding 1.0 mm irrespective of the chip diameter. It is supposed to be because an excessive increase in the projection height of the noble metal chip 16 causes poor heat transfer from the noble metal chip 16 to the main body of the ground electrode 14. Accordingly, the projection height of the noble metal chip 16 is set in a range from 0.2 mm to 1.0 mm, thereby allowing for improving the ignition performance for the air-fuel mixture while restraining the consumption of the noble metal chip 16.

Figure 22:
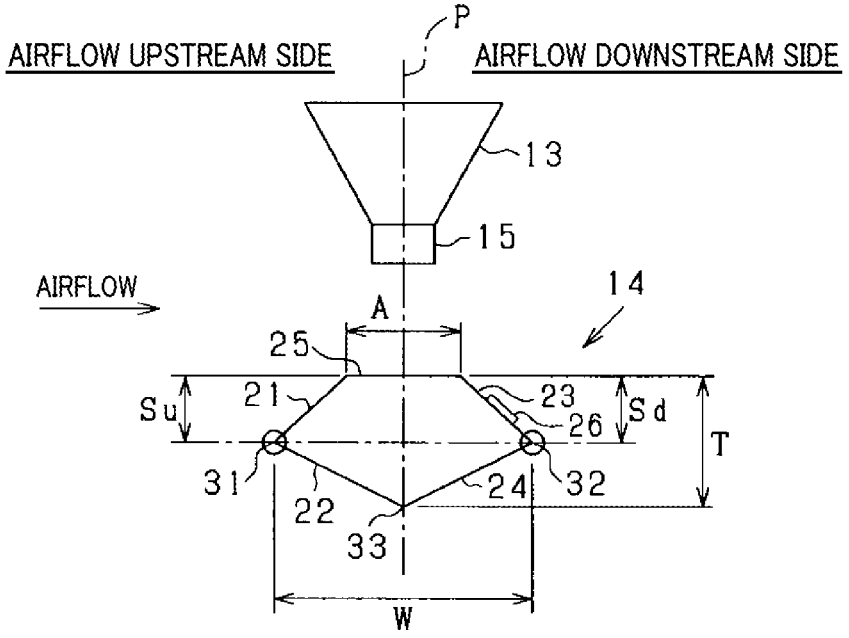
FIG. 22 is a schematic diagram illustrating another modification example of the ground electrode.
Figure 23:
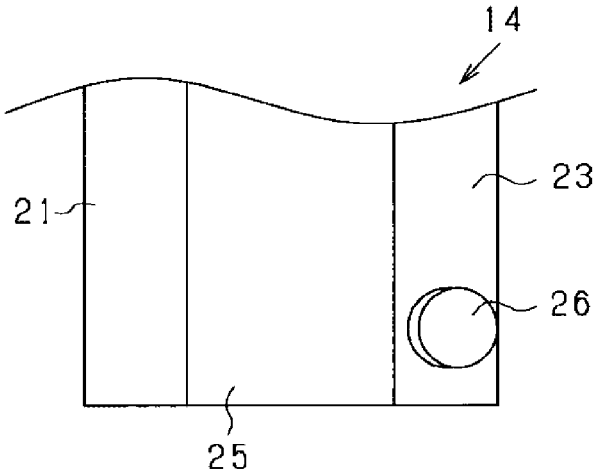
FIG. 23 is a plan view of the ground electrode of FIG. 22.

FIG. 22 is a schematic diagram illustrating another modification example of the ground electrode 14 and FIG. 23 is a plan view of the ground electrode 14 of FIG. 22. This ground electrode 14 does not include the noble metal chip 16 but a noble metal chip 26. The noble metal chip 26 (second noble metal chip) is in a form similar to that of the noble metal chip 16. The noble metal chip 26 is welded to the third slanted surface 23. In particular, the noble metal chip 26 is provided on the third slanted surface 23 downstream of a portion of the facing portion 25 facing the distal end surface 15*a* of the center electrode 13. Thus, the concentration of electric field that occurs at the noble metal chip 26 makes it easier to displace the origin of the discharge spark in the ground electrode 14 to the noble metal chip 26. Further, the origin of the discharge spark can be retained at the noble metal chip 16, so that the consumption of the ground electrode 14 due to the discharge can be restrained by the noble metal chip 26.

Figure 24:
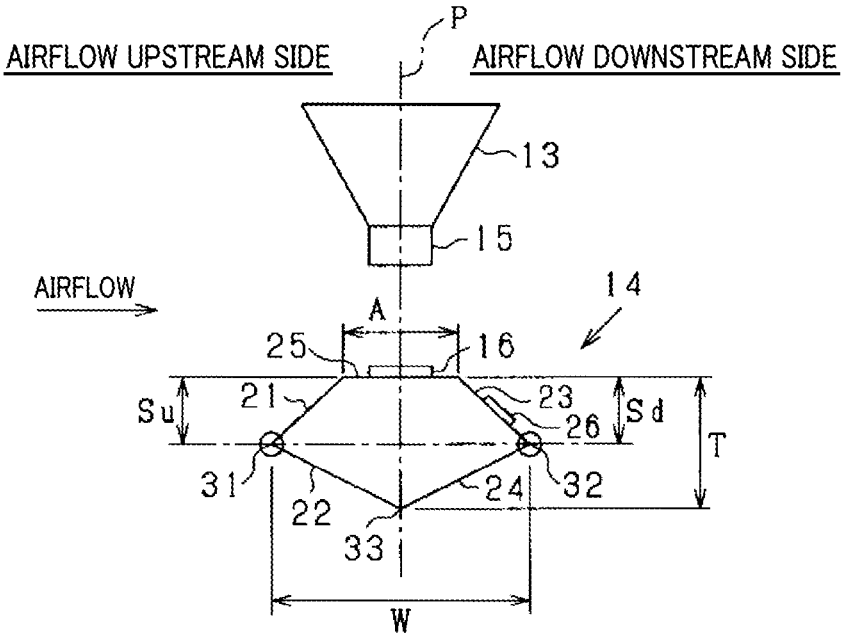
FIG. 24 is a schematic diagram illustrating another modification example of the ground electrode.
Figure 25:
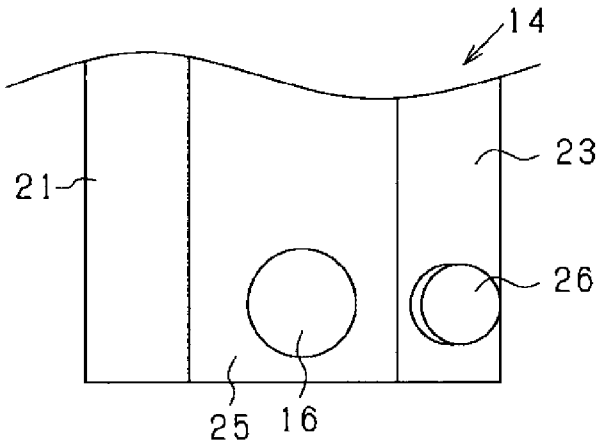
FIG. 25 is a plan view of the ground electrode of FIG. 24.

FIG. 24 is a schematic diagram illustrating another modification example of the ground electrode 14 and FIG. 25 is a plan view of the ground electrode 14 of FIG. 24. This ground electrode 14 includes the noble metal chip 16 and the noble metal chip 26. The noble metal chip 26 includes a material similar to that of the noble metal chip 16. A diameter of the noble metal chip 26 is slightly smaller than a diameter of the noble metal chip 16. In such a configuration, the concentration of electric field that occurs at the noble metal chip 16 makes it easier to cause discharge between the ground electrode 14 and the center electrode 13. Further, the concentration of electric field that occurs at the noble metal chip 26 makes it easier to displace the origin of the discharge spark in the ground electrode 14 from the noble metal chip 16 to the noble metal chip 26. Therefore, the consumption of the ground electrode 14 due to the discharge can be restrained by the noble metal chips 16 and 26. It should be noted that the origin of the discharge spark in the ground electrode 14 may be displaced in order of the noble metal chip 16, the third slanted surface 23, and the noble metal chip 26, or may be displaced from the noble metal chip 16 to the noble metal chip 26 with the third slanted surface 23 skipped.

Figure 26:
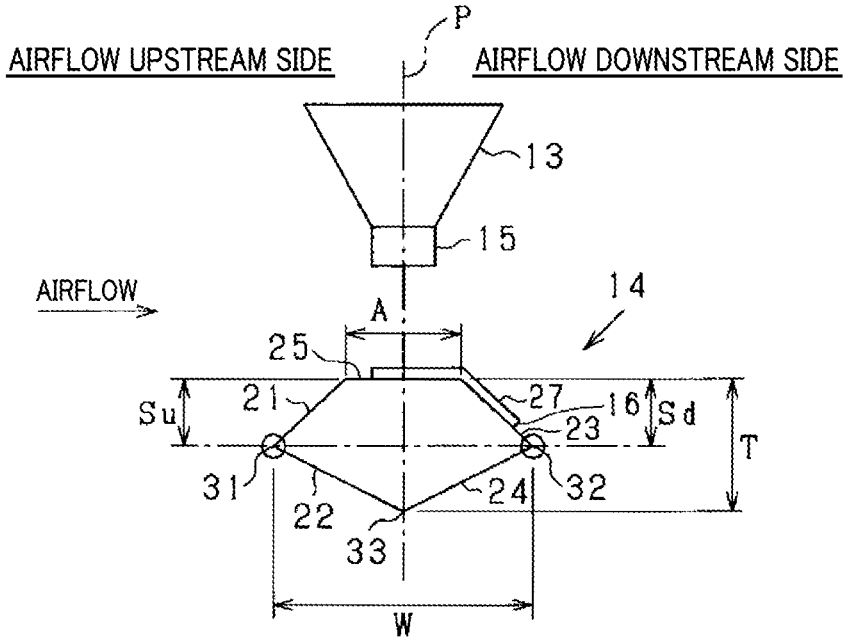
FIG. 26 is a schematic diagram illustrating another modification example of the ground electrode.
Figure 27:
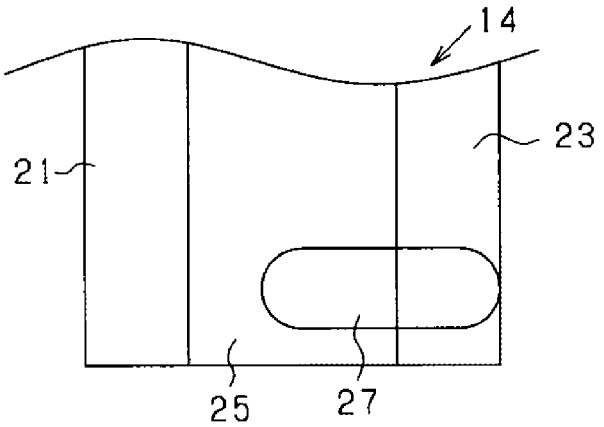
FIG. 27 is a plan view of the ground electrode of FIG. 26.

FIG. 26 is a schematic diagram illustrating another modification example of the ground electrode 14 and FIG. 27 is a plan view of the ground electrode 14 of FIG. 26. This ground electrode 14 is provided with a noble metal chip 27 (first to third noble metal chips) extending from the portion of the facing portion 25 facing the distal end surface 15*a* of the center electrode 13 to a predetermined position in the third slanted surface 23. In particular, the noble metal chip 27 is provided from the portion of the facing portion 25 facing the distal end surface 15*a* of the center electrode 13 to the facing portion 25 and the third slanted surface 23 downstream thereof. The predetermined position is a position where the origin of the discharge spark can be retained at the noble metal chip 27. Thus, the concentration of electric field that occurs at the noble metal chip 27 makes it easier to cause discharge between the ground electrode 14 and the center electrode 13. It also makes it easier to displace the origin of the discharge spark in the ground electrode 14 toward the downstream side of the airflow along the noble metal chip 27. Further, the consumption of the ground electrode 14 due to the discharge can be restrained by the noble metal chip 27. It should be noted that the noble metal chip 27 may include a combination of a plurality of noble metal chips. Further, the shape of the noble metal chip is not limited to a column but may be a triangular prism or a polygonal prism.

Although the present disclosure has been described with reference to the embodiment, it is to be understood that the present disclosure is not limited to the embodiment and structure. The present disclosure encompasses various modification examples and modifications within a scope of the equivalence. In addition, not only various combinations and configurations but also other combinations and configurations including only one element, more, or less are within the scope and spirit of the present disclosure.

What is claimed is:

1. A spark plug comprising:

a cylindrical main metal fitting;

a center electrode inserted in the main metal fitting; and a ground electrode coupled to the main metal fitting and curved so as to face a distal end surface of the center electrode with a predetermined plane along the curved ground electrode facing in a flow direction of airflow, wherein in a main body of the ground electrode, a first slanted surface is formed at a portion on a side facing the distal end surface of the center electrode and upstream of the center electrode relative to a flow of the airflow, the first slanted surface approaching the distal end surface from an upstream side toward a downstream side of the airflow, a facing portion that is least distant from the distal end surface is provided at a position facing the distal end surface, a second slanted surface is formed at a portion on a side opposite to the side facing the distal end surface of the center electrode and upstream of the center electrode relative to the flow of the airflow, the second slanted surface receding from the distal end surface from the upstream side toward the downstream side of the airflow, and when with respect to an insertion direction of the center electrode, T represents a thickness of the main body of the ground electrode and Su represents a distance from a connection between the first slanted surface and the second slanted surface to the facing portion, $2T/16 \leq Su \leq 8T/16$.

2. The spark plug according to claim 1, wherein in the main body of the ground electrode, a third slanted surface is formed at a portion on the side facing the distal end surface of the center electrode and downstream of the center electrode relative to the flow of the airflow, the third slanted surface receding from the distal end surface from the upstream side toward the downstream side of the airflow, a fourth slanted surface is formed at a portion on the side opposite to the side facing the distal end surface of the center electrode and downstream of the center electrode relative to the flow of the airflow, the fourth slanted surface approaching the distal end surface from the upstream side toward the downstream side of the airflow, and when Sd represents a distance from a connection between the third slanted surface and the fourth slanted surface to the facing portion with respect to the insertion direction of the center electrode, $2T/16 \leq Sd \leq 8T/16$.

3. The spark plug according to claim 2, wherein in the main body of the ground electrode, with respect to the insertion direction of the center electrode, the distance from the connection between the first slanted surface and the second slanted surface to the facing portion and the distance from the connection between the third slanted surface and the fourth slanted surface to the facing portion are equal.

4. The spark plug according to claim 3, wherein in the main body of the ground electrode, $4T/16 \leq Su \leq 6T/16$ and $4T/16 \leq Sd \leq 6T/16$ with respect to the insertion direction of the center electrode.

5. The spark plug according to claim 4, wherein in the main body of the ground electrode, when W represents a width of the main body of the ground electrode with respect to a direction orthogonal to the predetermined plane, $2 \leq W/T \leq 2.36$.

6. The spark plug according to claim 2, wherein an outer surface of the connection between the first slanted surface and the second slanted surface and an outer surface of the connection between the third slanted surface and the fourth slanted surface are each in a form of a rounded surface.

7. The spark plug according to claim 2, wherein the second slanted surface and the fourth slanted surface are recessed toward a center of the main body of the ground electrode.

8. The spark plug according to claim 2, wherein a portion of the facing portion facing the distal end surface of the center electrode is provided with a first noble metal chip.

9. The spark plug according to claim 2, wherein the third slanted surface is provided with a second noble metal chip.

10. The spark plug according to claim 2, wherein a third noble metal chip extending from a portion of the facing portion facing the distal end surface of the center electrode to a predetermined position in the third slanted surface is provided.

11. The spark plug according to claim 8, wherein a height of a projection of the first noble metal chip from the facing portion is in a range from 0.2 mm to 1.0 mm.

12. The spark plug according to claim 1, wherein a distal end portion of the center electrode is provided with a fourth noble metal chip.

* * * * *